United States Patent [19]

Ieda

[11] 3,959,920

[45] June 1, 1976

[54] BREAKAWAY STUNT CAR

[75] Inventor: Michael Ieda, Fort Solanga, Long Island City, N.Y.

[73] Assignee: Ideal Toy Corporation, Hollis, N.Y.

[22] Filed: Jan. 8, 1975

[21] Appl. No.: 539,369

[52] U.S. Cl. ..... 46/201; 46/209

[51] Int. Cl.[2] ..... A63H 17/02; A63H 29/20

[58] Field of Search ..... 46/93, 201, 202, 209

[56] References Cited

UNITED STATES PATENTS

| | | | |
|---|---|---|---|
| 2,338,803 | 1/1944 | Donofrio | 46/93 |
| 2,558,257 | 6/1951 | Koepnick | 46/93 |
| 2,757,482 | 8/1956 | Brown et al. | 46/201 |
| 3,176,429 | 4/1965 | Brown et al. | 46/201 |

*Primary Examiner*—Louis G. Mancene
*Assistant Examiner*—Robert F. Cutting

[57] ABSTRACT

A breakaway type toy vehicle has a chassis and a body which is removably mounted thereon. The body includes a plurality of body elements each of which is releasably connected to at least one other body element. Impact responsive means are provided in the vehicle for propelling one of the body elements away from the vehicle's chassis upon an impact therewith. The propulsion of this one body element causes sequential breakaway of the body elements from the chassis as the first propelled body element draws with it the body element to which it is connected.

19 Claims, 8 Drawing Figures

FIG. 8
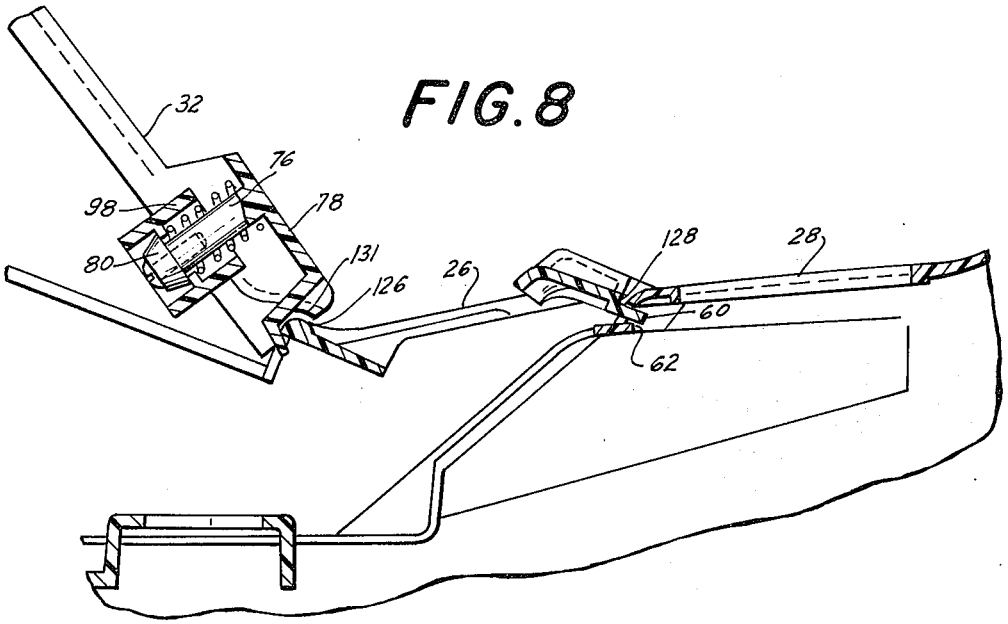
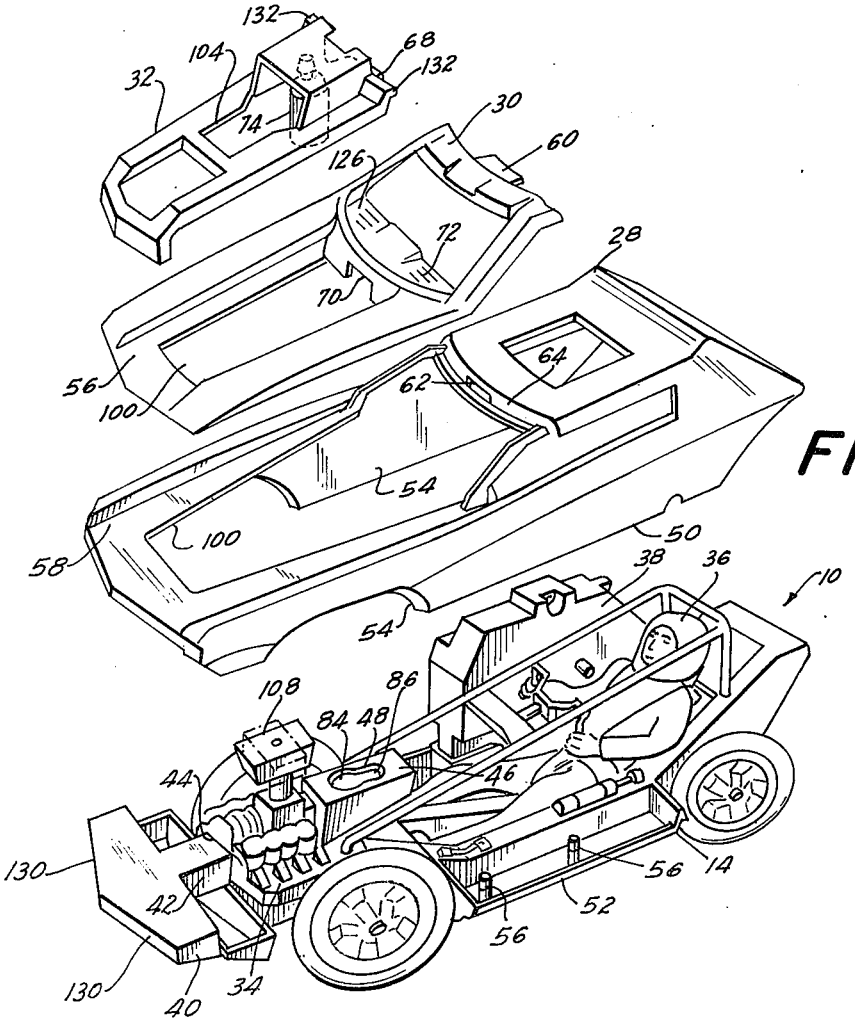
FIG. 3

BREAKAWAY STUNT CAR

The present invention relates to toy vehicles, and more particularly to a breakaway type toy vehicle in which the body elements of the vehicle break away in sequence.

Toy vehicles having body portions or elements which break away, or which are propelled from the vehicle, upon an impact against a portion of the vehicle have been previously provided in a variety of forms. The most typical arrangement for a breakaway vehicle is one in which all of the elements of the vehicle body are simultaneously propelled away from the vehicle chassis. Two such arrangements are shown for example in U.S. Pat. Nos. 2,757,482 and 3,176,429 to Brown et al. In such arrangements, the body elements are held in an assembled configuration against the bias of an ejecting spring by a latch mechanism. When the latch is released upon impact of the vehicle with an object, the spring force is applied directly to all of the body elements so that a simulated explosion is produced wherein all of the body elements simultaneously move away from the chassis. Although such previously proposed arrangements have been generally satisfactory in use, they do not simulate a realistic deterioration or break away of a vehicle after an accident wherein separate body elements are sequentially torn from the vehicle chassis, rather than being simultaneously pulled or propelled therefrom.

Accordingly, it is an object of the present invention to provide a breakaway type toy vehicle in which the elements of the vehicle break away or move from the vehicle in sequence.

Another object of the present invention is to provide a sequential break away of body elements for a toy vehicle in response to an impact against the vehicle.

Another object of the present invention is to provide a breakaway type toy vehicle which is relatively inexpensive in manufacture and durable in use.

Yet another object of the present invention is to provide a breakaway toy vehicle which is power driven so that the movement of the toy vehicle after an impact will aid in the sequential break away of the body elements thereof.

In accordance with one aspect of the present invention a breakaway type toy vehicle is provided which consists of a chassis having a plurality of ground engageable wheels rotatably mounted thereon. A breakaway body is removably mounted on the chassis and, in accordance with one embodiment of the invention, the body includes three body elements. A first of these body elements is releasably engaged with the chassis; the second body element is releasably connected to the first body element; and the third body element is releasably connected to the second body element.

A latch and spring arrangement are provided in the vehicle and it is operatively connected between the vehicle chassis and the third body element for propelling the third body element away from the chassis in response to an impact with the vehicle. The propulsion of the third body element from the vehicle in this manner causes the third body element to draw the second body element with it, through its releasable connection, away from the chassis. The second body element in turn draws the first body element away from the chassis in a sequential break away of the body elements from the chassis. By this construction only the third body element is directly subjected to the propulsion effect of the spring, and once it begins to move away it sequentially pulls the body element to which it is connected away from the vehicle chassis. In addition the vehicle may be provided with a power drive so that it will continue to move after impact with an object. Such continued movement produces a wind effect on the body elements being pulled from the vehicle, which aids in the break away of the vehicle body.

The above and other objects, features and advantages of this invention, will be apparent in the following detailed description of an illustrative embodiment thereof, which is to be read in connection with the accompanying drawings, wherein:

FIG. 3 is an exploded perspective view of the breakaway toy vehicle constructed in accordance with the present invention;

FIG. 8 is a sectional view, similar to FIG. 7, showing the sequential break away of the body elements after an impact.

Figure 1:
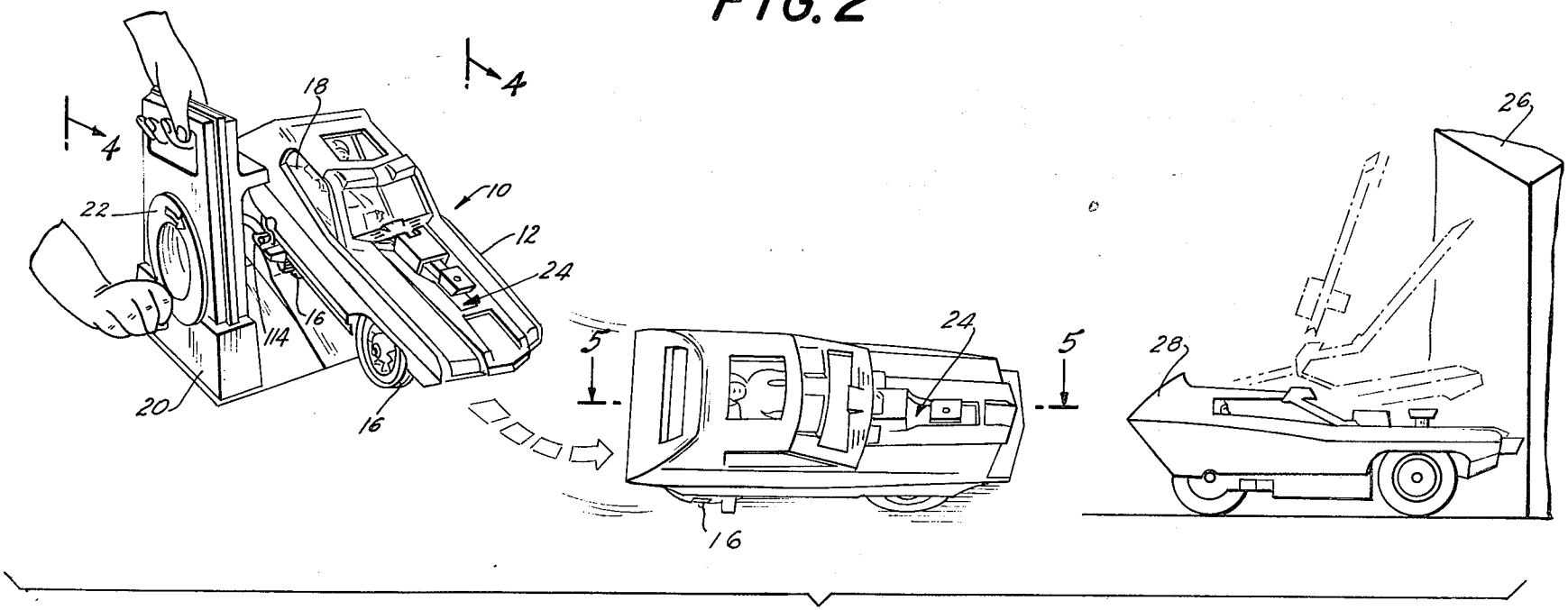
FIG. 1 is a perspective view of a breakaway type toy vehicle constructed in accordance with the present invention showing the manner in which the vehicle's power motor is energized and the operation of the vehicle just prior to impact with an object.
Figure 4:
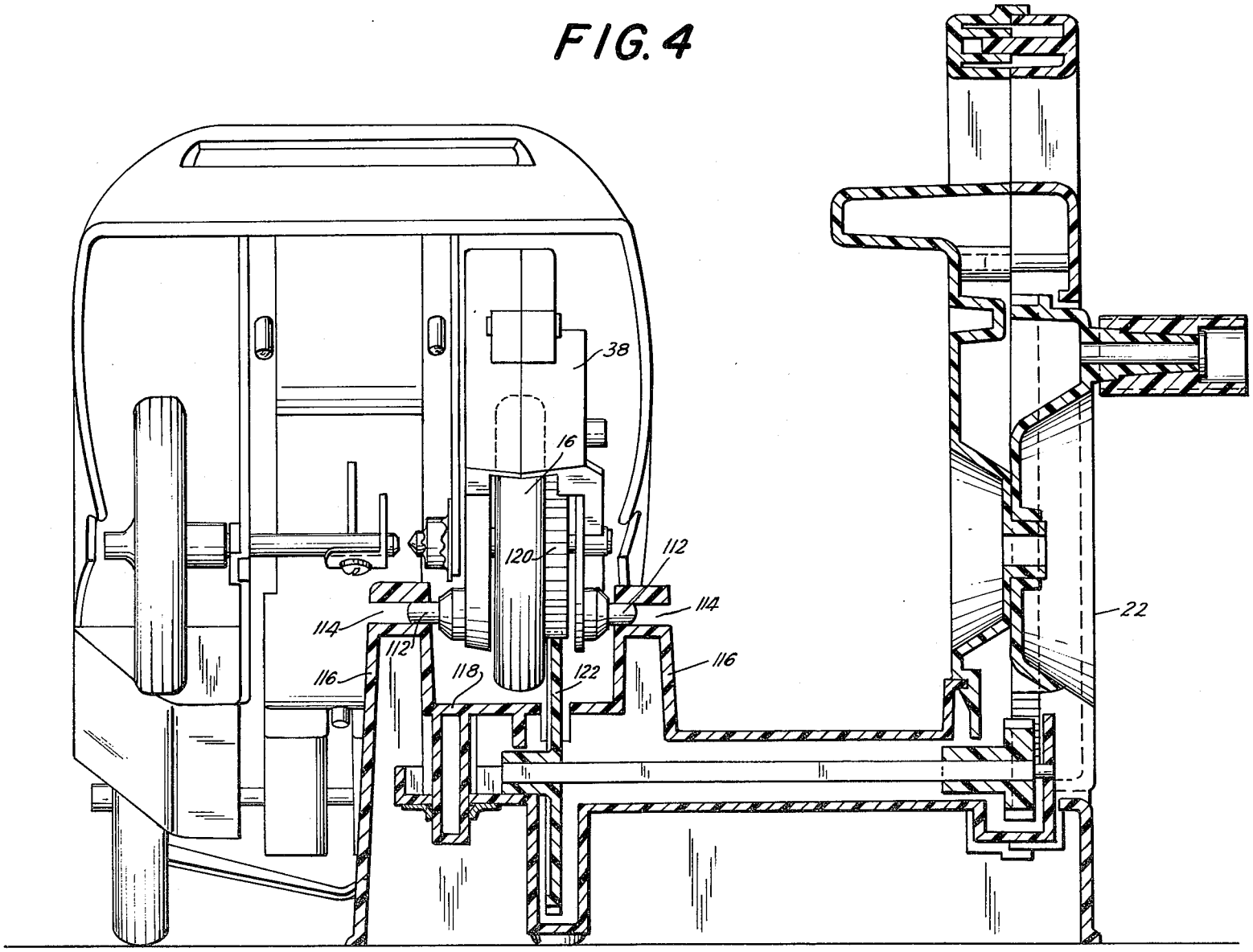
FIG. 4 is a sectional view taken along line 4—4 of FIG. 1, showing the wind up mechanism for the flywheel motor of the vehicle.

Referring now to the drawing in detail, and initially to FIG. 1 thereof, a toy vehicle 10, constructed in accordance with the present invention, includes a breakaway body 12 removably mounted on a vehicle chassis 14. The latter includes a plurality of ground engageable wheels 16 rotatably mounted thereon, with the right rear wheel 16 being driven by a flywheel motor 18. The flywheel motor is energized for driving the right rear wheel 16 by an energizer structure 20, which is identical to the energizer structure described in U.S. Pat. application Ser. No. 438,821, filed Feb. 1, 1974, now U.S. Pat. No. 3,886,682; June 3, 1975 and commonly assigned herewith. Operation of the energizer 20 energizes the flywheel motor 18 while holding at least the right rear drive wheel off of the ground in an elevated position so as not to interfere with rotation of that wheel. Once the drive wheel is rotating at a desired speed, rotation of the crank 22 in the energizer is stopped and the vehicle is automatically expelled from the energizer.

Since only the right rear wheel 16 of the vehicle is driven, when the rear wheels of the vehicle touch the ground the vehicle tends to veer sharply to the left at an angle of about 45°. Simultaneously, because of the effect of the flywheel motor and the drive to the single rear wheel, the vehicle will also tilt and initially move forward only on the two right wheels, as seen in the central illustration of FIG. 1. After traveling a substantial distance the vehicle will move back down to its normal drive position with all four wheels on the ground.

Vehicle 10 includes a breakaway control mechanism 24 mounted in the chassis 14 for cooperation with the body 12. Either before or after the vehicle straightens itself, should the vehicle impact against an obstruction or object, such as for example a chair leg 26 or the like, the breakaway mechanism will cause the vehicle's body to be propelled away from the vehicle in a sequential break away of the body elements.

In accordance with the illustrative embodiment of the present invention the body 12 is formed of three body elements; namely a main body portion 28, a simulated main hood portion 30, and a simulated hood 32. Each of the body elements 28, 30 and 32 are releasably connected to one another, as illustrated schematically in FIG. 2, with only the uppermost body element 32 operatively connected to the breakaway mechanism 24. As described hereinafter, this breakaway mechanism includes a spring which will expel or move the body element 32 away from the vehicle chassis upon an impact. This is illustrated schematically in the leftmost figure of FIG. 2. As the element 32 moves from the closed position illustrated in FIG. 1 to the open or expelled position of FIG. 2, under the influence of the spring of the breakaway mechanism, it will pull with it the body element 30 which, as it moves away from the chassis, applies a lifting force to the body element 28, to pull that body element away from the chassis 14. This sequential operation is illustrated schematically in FIG. 2. As a result, there is a sequential break away of the vehicle body elements. Moreover, since the vehicle 10 is power driven, as for example by the flywheel motor, after an impact it will continue to move along the play area. This movement will produce a wind effect on the body elements 30, 32 as they move to the positions shown in FIGS. 1 and 2, which will aid in pulling these body elements away from the chassis and in sequentially pulling the body element 28 therefrom.

As seen in FIG. 3, the chassis 14 of the toy vehicle 10 simulates the chassis of a sports vehicle and includes a simulated engine 34, a removable toy figurine 36, and a flywheel motor housing 38 for the motor 18. In addition, the chassis includes a front bumper 40 which is integrally connected or formed with a latch bar 42 that is slidably mounted in an elongated longitudinally extending channel 44 in the simulated engine 34. The inner end 46 of the latch bar 42 has a keyway 48 formed therein for latching engagement with the body element 32, as described hereinafter.

The main body element 28, as seen in FIG. 3, is formed as a shell from a thin lightweight plastic material and simply sits on the periphery of the chassis 14, with its lower edge 50 engaging the peripheral edge 52 of the chassis and its inner edge surfaces 54 frictionally engaged with locating pins 56 (only two of which are seen in FIG. 3) formed on opposite sides of the chassis.

The body element 30 consists of a simulated plastic hood and windshield portion for the vehicle and is superimposed on and received in a front well 58 formed in the body element 28. In addition body element 30 includes a tab 60 which, in the assembled configuration of the vehicle, is inserted in an opening or recess 62 formed in the upper edge or headwall 64 of body element 28 so that the tab 60 extends beneath the upper portion of the top of the vehicle.

Finally, body element 32 consists of a simulated engine hood (also formed of plastic) which is adapted to be seated in the recess or well 66 formed in body element 30. Body element 32 includes a tab 68 which is adapted to be received within the recess or opening 70 formed beneath the simulated dashboard 72 of body element 30. In addition, body element 32 includes a latching member 74 for engagement with the keyway 48 of latch bar 42, as described hereinafter.

In order to assemble the various body elements on the toy vehicle, body element 28 is first seated on the chassis 14 with its sidewalls 54 in engagement with pins 56. The body element 30 is then placed in well 58 and moved rearwardly along the well until the tab 60 is engaged in the aperture 62. Thereafter, the body element 32 is placed in well 66 and moved rearwardly to engage its tab 68 in the recess 70.

Figure 6:
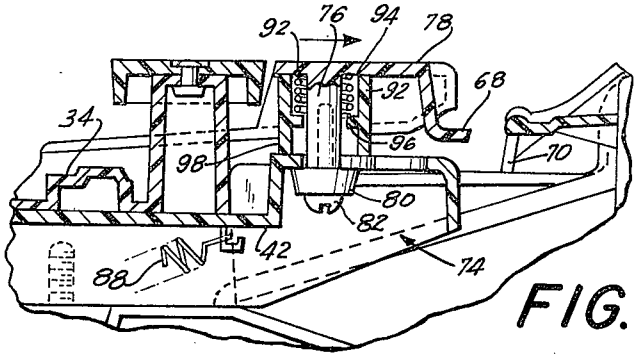
FIG. 6 is a partial elevational view, in section, illustrating how one of the body elements is engaged with the releasable latch in the vehicle's chassis.
Figure 5:
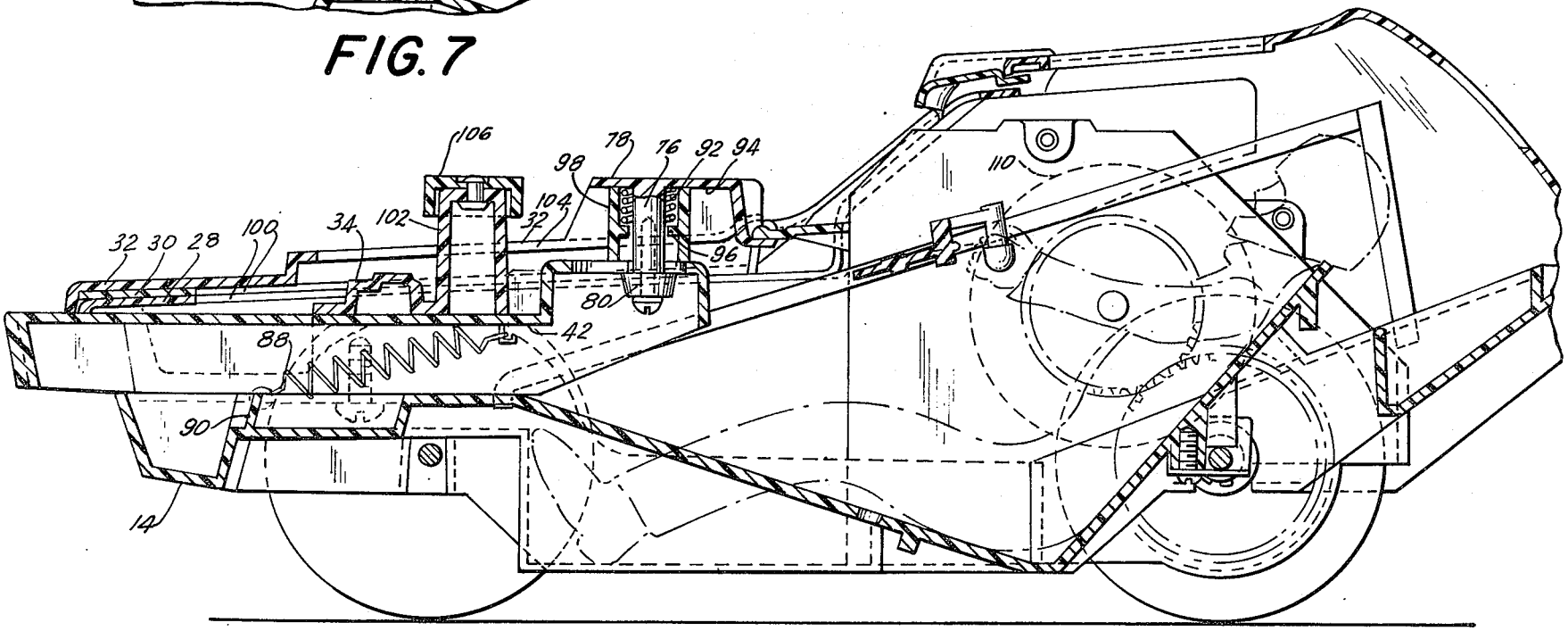
FIG. 5 is a longitudinal sectional view taken along line 5—5 of FIG. 1, showing the vehicle's body elements in their assembled configuration.

The latching mechanism 74 is engaged with the keyway 48 in the latch bar 42 when the body element 32 is assembled to body element 30 by placing it in well 66. This latching element includes a stud 76 integrally formed on the lower surface of a cowling or air scoop formed in the hood 32. The lower end of the stud includes an enlargement or boss 80 secured thereto by a screw 82. The boss 80 is initially inserted through the enlarged portion 84 of keyway 48, as seen in FIG. 6, and the body element is thence moved to the right, as indicated by the arrow in FIG. 6, to engage the tab 68 in the recess 70. This movement of the hood 32 causes the stud 76 to enter the narrow section 86 of the keyway 48 so that the enlargement 80 is trapped beneath latch bar 42. The latter is biased to a first forward position, illustrated in FIGS. 5 and 6, by a spring 88 operatively connected between the latch bar 42 and a hook or boss 90 on chassis 14.

Figure 7:
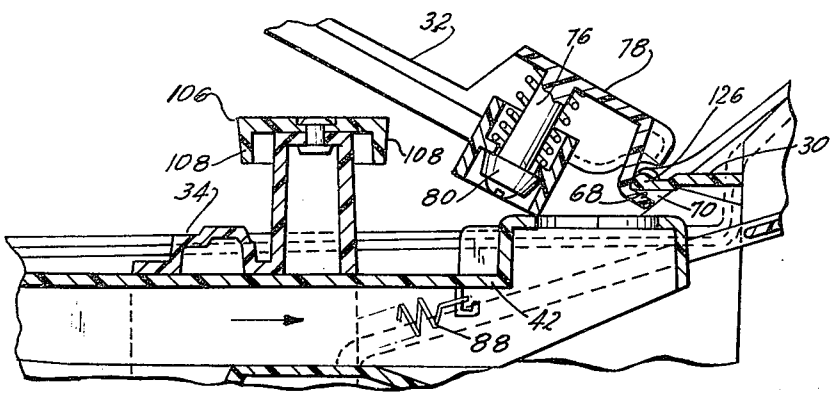
FIG. 7 is a partial elevational view, similar to FIG. 6, showing the release and propulsion of the body element connected to the latch, upon a vehicle impact.

Latching mechanism 74 also includes a coil spring 92 which surrounds the stud 76 and is retained between the lower surface 94 of the air scoop 78 and an annular flange 96 formed in a cylindrical collar 98 which also surrounds the stud 76. The spring 92 normally biases the collar 98 away from the surface 94, so that flange 96 engages the enlargement 80, as seen in FIG. 7. However, when hood 32 is assembled to the vehicle the collar 98 is enlarged against the rear portion 46 of the latch bar and the hood is pushed downwardly to compress spring 92 and allow the enlargement 80 to be inserted in the keyway 48. After the hood is moved to the right, as illustrated in FIG. 6, the enlargement 80 is positioned below the latch bar in the narrow section 86 of the keyway so that the spring 92 is held in its compressed condition and the body elements remain in their assembled configuration.

As can be seen most clearly in FIG. 3, the body elements 28 and 30 each have openings 100 formed therein over the simulated engine 32 of the vehicle so that the stud 96 can pass therethrough into engagement with the latch bar.

With the body elements assembled in this manner, when the bumper 40 of the vehicle engages an obstruction, with sufficient force, it is moved rearwardly, from the position shown in FIG. 6 to the position shown in FIG. 7, against the bias of spring 88. Since hood element 32 is prevented from moving to the right because of its engagement with body element 30 (FIG. 5) this movement of the bumper and its integral latch bar presents the enlarged open section 84 of the keyway above the enlargement 80 on stud 76 so that the enlargement is free for movement through the latch bar.

With the enlargement 80 freed in this manner, the spring 92 can expand to propel the hood element 32 upwardly, thereby causing the hood element to pivot about its connection with the body element 30, at the tab 68, as seen in FIG. 7.

In order to prevent inadvertent or undesired break away of the body elements during play or storage of the toy vehicle, the chassis 10 is provided with a post 102 integrally formed with the simulated engine 34. The post 102 extends through the openings 100 in body elements 28, 30 and through an opening 104 in body element 32. The upper end of the post is provided with a stop knob 106 which is pivotally mounted on the post. The knob has a generally rectangular configuration, as seen most clearly in FIG. 3, and when rotated to the dotted line position thereof shown in FIG. 3, its ends 108 extend across the opening 104 to prevent upward pivotal movement of the hood. On the other hand, when the stop 106 is rotated to the solid line position in FIG. 3 (also shown in FIGS. 6 and 7) the stop can pass through the opening 104 and does not interfere with movement of the hood.

In use, the vehicle 10 is placed on the energizer 20, to allow the user to energize the flywheel 110 in the flywheel motor housing 38. The flywheel motor 18 used in the vehicle of the present invention is substantially identical to that described in the above mentioned patent application and includes a drive train from the flywheel to the drive wheel 16 of the vehicle.

The housing 38 also includes a pair of oppositely extending studs or projections 112 on opposite sides of the housing which are placed in recesses 114 formed in abutments 116 on the energizer. These recesses are opened in the direction of travel of the vehicle (see FIG. 1) and support the vehicle on the energizer with the rear drive wheel 16 out of engagement with the support surface 118 thereof. In this manner a gear 120 of the flywheel motor is engaged with an energizing gear 122 in the energizer housing. The latter gear is rotated by operation of the crank 22 so as to rotate the gear 122 and thus the flywheel 110. When the flywheel is driven to the desired speed, rotation of crank 22 is stopped, and the interaction of gears 120, 122 causes the vehicle to move forward off of the energizer.

As mentioned, since only the right rear drive wheel 16 of the vehicle is driven the vehicle will make a sharp turn to the left after it leaves the energizer and, if the flywheel is driven at sufficiently high speeds, will move forward initially only on the two right wheels.

Figure 2:
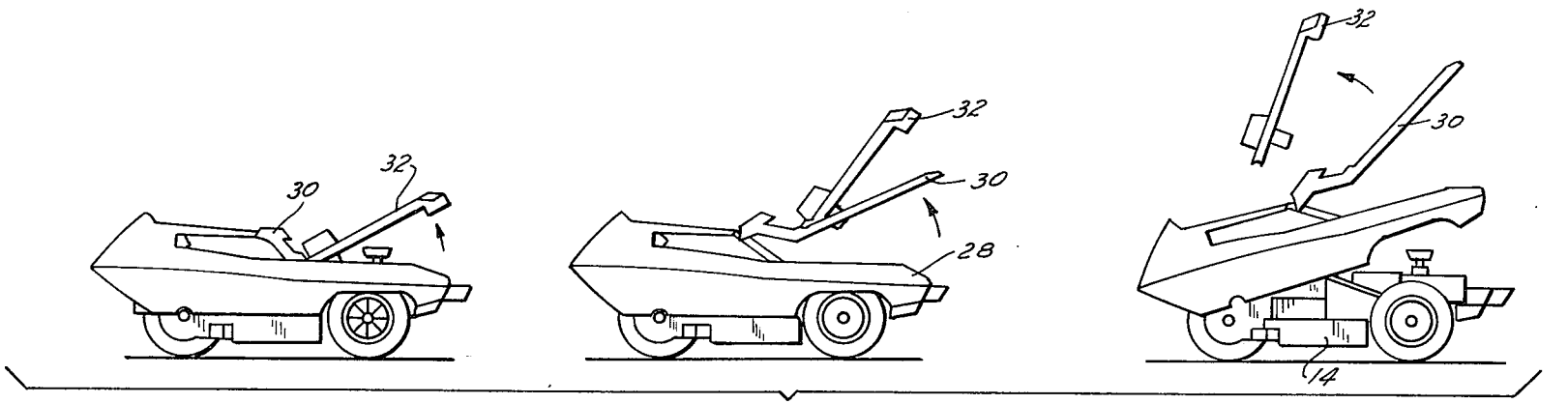
FIG. 2 is an elevational view showing the sequential break away of the body elements of the vehicle of the present invention.

If the stop member 106 is placed in its solid line position shown in FIG. 3, so as not to interfere with movement of the hood 32, when the vehicle's bumper 40 strikes an object, the movement of the vehicle will cause the bumper and thus latch bar 42 to move inwardly of the vehicle. As a result, the enlargement 80 will be released through the enlarged open section 84 of the slot 48, in the manner described above, as spring 92 expands to pivot hood 32 about its connection with the body element 30. The pivotal movement of the hood 32 in this manner causes an upward force to be applied to the edge 126 of the body element 30 adjacent recess 70. This upward force tends to lift the body element 30 away from the body element 28, in effect peeling body element 30 from the body element 28. The resulting pivotal movement of body element 30 is illustrated in FIG. 8 wherein it is seen that lifting of the body element 30 by the hood 32 causes the body element to pivot about its connection with the main body element 28, at its tab 60. This in turn produces an upward lifting force on the body element 28, at the edge 128 thereof adjacent recess 62, thereby lifting or peeling the body element 28 from the chassis 14, as illustrated in FIG. 2.

Since the vehicle 14 is power driven by a high energy flywheel motor, the vehicle will continue to move after an impact. In addition, because the bumper 40 is generally arrow shaped, having inclined impact surfaces 130 formed thereon, an impact of the bumper with an object will cause the vehicle to be deflected so that it can continue moving along a path of travel. As a result of this continued movement of the vehicle, a wind or drag effect will be produced on the body elements as they are peeled from the chassis. Thus, for example, when the hood element 32 is pivoted to the position illustrated in FIG. 7, the wind or drag effect will operate against the lower surface of the hood to aid in its pivotal movement and the application of a lifting force on the body element 30. Similarly, once the body element 30 has begun to pivot, as illustrated in FIG. 8, the wind or drag effect on its lower surface will further aid in peeling the body element 28 from the chassis 14. In this manner, a sequential break away or peeling off of the body elements from the chassis is enhanced.

It is noted that the connection between the body elements formed by their respective tabs and recesses is selected to insure the pivotal movement of the body elements with respect to one another. That is, the tabs 60, 68 are inserted in their associated recesses to be below a portion of the body element to which they are connected, so that rearward and upward movement of the body elements with respect to one another is restricted. Thus, for example, the rear 130 of the air scoop 32 is engaged against the front edge 126 of the body element 30. This insures that the action of the spring 92 will cause pivoting movement of the hood element 32. In addition, the hood element 32 has a flange portion 132 adjacent the air scoop 78 which will overlie the edge 126 of the body element 30 to form, with edge 126, a hinge about which the hood element 32 can pivot when the spring 92 is released. The pivotal movement insures the sequential break away of the elements from the vehicle and presents the hood element to the wind effect in a proper position for the wind effect to act on the body elements to aid in the sequential break away of the body.

Accordingly, it is seen that the toy vehicle 10, constructed in accordance with the present invention, provides a relatively simply constructed vehicle arrangement which produces a realistic simulation of the destruction of a vehicle upon impact, with the various body elements being pulled from the vehicle in sequence, and with each body element acting on a subsequent body element to simulate the break away. This is achieved with a minimum of parts and a relatively simple latch structure.

Although an illustrative embodiment of the present invention has been described herein with reference to the accompanying drawing, it is to be understood that the invention is not limited to that precise embodiment thereof, but that various changes and modifications may be effected therein by one skilled in the art without departing from the scope or spirit of this invention.

What is claimed is:

1. A toy vehicle comprising a chassis and a body removably mounted on said chassis, said body including a plurality of body elements each of which includes means for releasably connecting it to at least one other body element; and means on the vehicle responsive to an impact therewith for propelling one of said body elements away from said vehicle; said body elements being positioned in superimposed relation to one another with said one body element being positioned on top of the other body element in the assembled condition of the vehicle; said impact responsive means including releasable latch means for engaging said one body element and maintaining it in assembled relation to the other body elements; whereby said other body elements are held in assembled relation between the chassis and said one body element and propulsion of said one body element will cause a sequential break away of the body elements from the chassis as said one body element draws with it the body element to which it is connected and each body element then successively draws with it the body element to which it is connected.

2. The toy vehicle as defined in claim 1 wherein said releasable connecting means comprise cooperating tongues and recesses formed in said body elements.

3. The toy vehicle as defined in claim 1 wherein said impact responsive means comprises a latch bar mounted in said chassis for movement from a first latching position to a second unlatching position in response to an impact on the latching bar; cooperating means formed on said latch bar and said one body element for latching said one body element to said latch bar in the first latching position thereof, and spring means for applying a biasing force to said one body element urging it away from said chassis whereby said spring propels said one body element away from the chassis when the latch bar is moved to its second position.

4. The toy vehicle as defined in claim 3 wherein said latch bar includes an impact surface defining the front bumper of the vehicle, said impact surface having a pair of angularly related surface portions for deflecting the vehicle from its prior path of travel upon impact with an object.

5. The toy vehicle as defined in claim 1 wherein said vehicle has a plurality of ground engageable wheels and drive means for driving at least one of said wheels.

6. The toy vehicle as defined in claim 1 including selectively operable safety means for selectively preventing break away of said body elements even upon release of said latch means.

7. A toy vehicle comprising a chassis, a plurality of ground engageable wheels rotatably mounted on said chassis and a body removably mounted on said chassis, said body including a first body element releasably engaged with said chassis, a second body element releasably connected to the first body element and a third body element releasable connected to the second body element; and means in said vehicle operatively connected between said chassis and said third body element and responsive to an impact therewith, for propelling said third body element away from the chassis, whereby propulsion of said third body element causes said third body element to draw said second body element with it, through its releasable connection therewith, away from said chassis, and said second body element to draw said first body element away from said chassis in a sequential break away of the body elements from the chassis.

8. The toy vehicle as defined in claim 7 wherein said body elements are assembled in superimposed relation with said third body element being uppermost, said second and third body elements having apertures formed therein through which said means extends for engagement with said third body element.

9. The toy vehicle as defined in claim 8 wherein said third body element is a simulated hood for the vehicle.

10. The toy vehicle as defined in claim 8 wherein said impact responsive means comprises a latch bar slidably mounted in said chassis for movement from a first, latching position to a second, unlatching position in response to an impact against the bar; a spring operatively engaged between said chassis and said third body element normally urging the third body element away from the chassis; and cooperating means on said latch bar and third body element for latching said third body element to said latch bar in the first position thereof, against the bias of said spring, to hold the body elements in assembled relation on the chassis; said latch bar releasing said cooperating means upon movement to said unlatching position whereby said spring propels said third body element away from the chassis to initiate said sequential break away of the body elements.

11. The toy vehicle as defined in claim 10 wherein said second and third body elements each have tabs extending rearwardly therefrom and said second and first body elements having openings formed therein below a portion of their respective body elements for respectively receiving the tabs on said third and second body elements whereby upon propelling of said third body element by said spring, its tab applies an upwardly directed force to the second body element whose tab, in turn, applies an upwardly directed force to said first body element.

12. The toy vehicle as defined in claim 11 wherein said spring is positioned to pivot said third body element upwardly with respect to said second body element about the engagement of the tab of the third body element in its associated recess.

13. The toy vehicle as defined in claim 12 wherein the tab of said third body element is located forwardly of the tab on said second body element; said pivotal movement of the third body element by said spring thereby causing said second body element to pivot upwardly with respect to said first body element about the engagement of its tab in its associated recess of the first body element, said tab of said second body element thereby applying a lifting force to said first body element to pull the first body element from said chassis; the pivotal movement of said third and second body elements exposing the undersides of said elements, whereby continued movement of the vehicle after impact produces a wind-drag effect on the third and second body elements aiding in the break away of the body elements from the chassis.

14. The toy vehicle as defined in claim 10 wherein said cooperating means includes a stud on said third body element, said stud having an enlarged head and extending downwardly toward said latch bar through the apertures in said second and first body elements; said latch bar having a keyhole slot formed therein including a first portion adapted to receive said head and a second portion adapted to receive only the stud with said head trapped below the bar; said movement of said latch bar to its second position upon impact moving said slot with respect to said stud; and said slot portions being arranged such that the first slot portion is in alignment with the stud in the second position of the latch, thereby to release the stud head and allow the third body element to be propelled by said spring.

15. The toy vehicle as defined in claim 14 wherein said second and third body elements have abutting surface portions for preventing rearward movement of said third body element during an impact, whereby said third body element remains stationary as said latch bar moves from its first to its second position.

16. The toy vehicle as defined in claim 15 wherein said spring comprises a coil spring surrounding said stud; and a collar slidably mounted on said stud for engagement with said latch bar; said spring being trapped between said collar and said third body element and compressed when said stud is in the second portion of said slot, whereby said spring propels said third body element when the first portion of the slot is moved into alignment with the stud.

17. The toy vehicle as defined in claim 15 wherein said latch bar includes an impact surface defining the front bumper of the vehicle, said impact surface having a pair of angularly related surface portions for deflecting the vehicle from its prior path of travel upon impact with an object.

18. The toy vehicle as defined in claim 10 wherein said vehicle includes drive means for driving only one rear wheel of the vehicle.

19. The toy vehicle as defined in claim 10 including selectively operable safety means for selectively preventing break away of said body elements even upon release of said latch means.

* * * * *